US011830353B2

(12) United States Patent
Dale et al.

(10) Patent No.: US 11,830,353 B2
(45) Date of Patent: Nov. 28, 2023

(54) PORTABLE AND RAPID COMMUNICATION OR SIGNALING SYSTEMS WITH TACTILE IDENTIFICATION

(71) Applicant: The United States of America, as represented by the Secretary of the Navy, Crane, IN (US)

(72) Inventors: Kenny Dale, Panama City Beach, FL (US); Enrique Garza, Destin, FL (US); Noah Roberts, Bloomington, IN (US); Shawn Kelstrup, Tacoma, WA (US); Jesse Chen, Bloomington, IN (US); Gerrot Jones, Bloomington, IN (US); Lee Zaloudek, Laporte, CO (US); Darrel Yung, Bloomington, IN (US)

(73) Assignee: The United States of America, Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/884,016

(22) Filed: Aug. 9, 2022

(65) Prior Publication Data

US 2023/0037820 A1 Feb. 9, 2023

Related U.S. Application Data

(60) Provisional application No. 63/230,996, filed on Aug. 9, 2021.

(51) Int. Cl.
*G08B 6/00* (2006.01)

(52) U.S. Cl.
CPC ..... *G08B 6/00* (2013.01)

(58) Field of Classification Search
CPC ... G08B 6/00; A45F 5/02; G09F 13/16; G09F 13/20; G09F 3/10; G09F 19/22; G09F 21/00; A42B 3/0453
See application file for complete search history.

(56) References Cited

U.S. PATENT DOCUMENTS 8,494,507 B1 * 7/2013 Tedesco ..... G09B 21/00 455/418

FOREIGN PATENT DOCUMENTS

WO WO-03083811 A1 * 10/2003 ..... A01K 11/00

* cited by examiner

*Primary Examiner* — Toan N Pham
(74) *Attorney, Agent, or Firm* — Naval Surface Warfare Center, Crane Division; Christopher Feigenbutz

(57) ABSTRACT

A portable and rapid communication or signaling device and related methods for operating or using tactile identification structures as well as coupling/mounting/release structures which enable rapid identification of similarly shaped objects and rapid deployment or use with safety or other equipment. Various embodiments enable using a common mounting location of these similarly shaped objects that each have different spectrum or color emissive capabilities that improve operator selection within conditions further impairing identification and employment and increase operator cognitive load.

15 Claims, 11 Drawing Sheets

PORTABLE AND RAPID COMMUNICATION OR SIGNALING SYSTEMS WITH TACTILE IDENTIFICATION

CROSS-REFERENCE TO RELATED APPLICATIONS

The present application claims priority to U.S. Provisional Patent Application Ser. No. 63/230,996, filed Aug. 9, 2021, entitled "PORTABLE AND RAPID COMMUNICATION OR SIGNALING SYSTEMS WITH TACTILE IDENTIFICATION," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200532US02) is assigned to the United States Government and is available for licensing for commercial purposes. Licensing and technical inquiries may be directed to the Technology Transfer Office, Naval Surface Warfare Center Crane, email: Cran_CTO@navy.mil.

FIELD, BACKGROUND, AND SUMMARY OF THE INVENTION

The present invention relates to systems and methods enabling an operator to maximize carrying and use of various portable equipment items or tools including a number of communication or signaling systems and other systems where the communication or signaling items are substantially similar or identical in appearance or structure (e.g., visual or tactile) and have different capabilities such that an operator has difficulty in distinguishing between the different but similarly or identically shaped items or tools particularly when mounted at a common mounting location. In particular, the field of the invention is directed to use of such items or tools in contexts where operators or users experience an increased difficulty of selection or identification (e.g., selecting from different spectrum or color light systems having a same or similar structure or distinguishing characteristics) when employed within a set of conditions that further impair selection or identification and employment. In particular, at least some embodiments are directed towards the field of tactical light systems and related methods.

For example, the field of the invention is directed to the field of use of portable equipment items or tools, such as for example communication and signaling tools or equipment items, within a context of a need for structures and methods which enable rapid and accurate selection/employment within a compressed decision time line, increased hazard/risk conditions, and/or identification/selection interference conditions or factors of one of a number of different ruggedized, lightweight, and portable tools or equipment items (e.g., communication or signaling systems) each having a different capability (e.g., signaling and/or communication capability such as, e.g., different spectrum and/or color emitting capability) that each have an identical shape or substantially identical shape or similar or substantially similar visual recognition characteristics.

Various embodiments address problems or needs associated with conditions or factors that interfere with such rapid and accurate selection/employment and distinguishability of one of multiple such communication or signaling systems (e.g., visual or infrared (IR) lighting) carried by operators or users. Various embodiments enable rapid and accurate identification, selection, and employment under compressed decision or selection time frames and high risk condition that reduces cognitive load of an operator required to perform such rapid identification, selection, and employment tasks within the context of such interference factors or conditions and equipment constraints.

In particular, various embodiments of the invention are directed to providing improved and/or new solutions or capabilities to operators who, prior to this invention, had difficulty in rapid identification/selection/distinguishing/employment between a number of different spectrum and/or color emitting lighting systems due selection/employment interference conditions, safety or hazard driven compressed selection timelines, physical/employment limitation factors, and/or cognitive load/distractive contributing factors. For example, such interference factors can include personal protective equipment interference and cognitive load or distractions from a primary attention focus (e.g., combat mission, rescue mission, firefighting, law enforcement, hostage rescue, low visibility conditions such as utility company activities within industrial structures, or impeded visibility hazard situations) while making such selection/employment actions to enable communication and/or signaling that reduce/limit distraction from the primary focus. Such interference or cognitive load factors can include high stress, high safety threat, and/or high adverse consequence risks or fear of failure mission or activity such as a tactical combat mission under either covert or high intensity combat operations).

Interference or cognitive load factors can also include factors arising from protective equipment such as tactical or safety gloves, including hazardous material handling or condition gloves, which reduce operator ability to use touch to distinguish between different similar or identically shaped signaling or communication structures (e.g., chemical or chemiluminescent device (CD) light systems) that include systems that look the same but are not the same. In some cases, such systems have identically shaped or substantially identically shaped outside structure or designs that are identified by wrappers or cases that the lighting or communication systems come within (e.g., CD lights). In at least some embodiments, such exemplary embodiments addressed situations where various identically shaped or similarly shaped signaling or communication systems are removed from their wrappers, the primary means of distinguishing between them is lost. This includes IR lighting or communication systems that have a same structure as visible spectrum lighting or communication systems particularly in low or no visibility conditions. During compressed timeline or high cognitive load conditions calling for rapid action, operators do not have a great deal of time to determine which one of the identically shaped or highly similarly shaped communication or lighting systems that emit different colors or spectrums is the one that is desired or needed.

Generally, various embodiments of the invention enable rapid and accurate tactile or increased distinctive/distinguishing between different visual shape based identification/selection and rapid employment of lightweight, simplified, rugged, disposable, small, rapidly activatable, quickly detachable from a connection point, different spectrum, and/or different color lighting systems that are employable by operators in selection and activation/employment conditions which vary from high visibility, low visibility and no visual spectrum or infrared spectrum (IR) visibility and who are also wearing safety or personal protection equipment which impede tactile identification. Various embodiments are further are directed to addressing problems or needs associated with situations where such lighting systems are employed by operators who have reduced ability to identify or select one of a number of different spectrum or light sources such as for example chemical reaction light based structures due to various factors which impede rapid identification of particular color or spectrum of a number of such light sources.

Existing solutions include using different tape patterns that are applied to different CDs. These taping solutions are not useful in cases where an operator has difficulty in viewing the taping patterns. The taping patterns are not helpful for tactile identification particularly with safety equipment interfering with attempts to feel the tape patterns. Other attempted solutions have included placing the CDs on different parts of an operator's body such as filling up different cargo pockets with different colored or different spectrum emissive capabilities. However, this solution fills up pockets or locations that are needed for other mounting or items and thereby impedes operator ability to integrate multiple items particular where an operator or user must maximize not only storage but an ability to use those storage locations for the same purpose of helping an operator know where other items are located such as batteries, medical equipment, ammunition, mission specific equipment, etc.

In particular, in one set of embodiments, operators must carry multiple color, spectrum, and simplified activation/energy source, lightweight, disposable oriented capability lighting systems such as CDs for marking during missions. Differentiating the different colors under low light conditions while wearing tactical gloves is extremely difficult, which could lead to miss-marking objects, obstacles, personnel, targets, and buildings. Various Navy activities have fabricated tactile identification structures or caps for use with exemplary communication, identification, action request, etc. systems and created improved methods in order to make similarly shaped or identically shaped case or object (e.g., CD structures) identification easier, faster, and more reliable.

Various problems were experienced in attempting to create various embodiments of the invention. For example, there was significant failure associated with coupling the tactile identification structures or caps or structures to a desired CD. First, adhesive was attempted but then it was discovered that the adhesive created significant difficulty in re-using the tactile structures particularly in cases where operators were deployed remotely and therefore were limited in their ability to carry items or access additional tactile identification structures or caps that were necessarily thrown away after a single use. Next, attempts were made to non-destructively couple the caps to the CDs. A first effort used elastic cord to couple a top and bottom cap with compressive force form the elastic cords. This elastic cord based embodiment created significant problems due to catching of the cords or the tactile identification structures or caps and then the CD fell out or disconnected from the tactile identification structures or caps; alternatively, the elastic cord design was interfering with other motions or user activities. The elastic cords also added bulk, weight, part count, and otherwise created snag hazards.

Also, exemplary CDs have internal breakage structures (e.g., glass), which has to be factored in when creating a workable design for the invention. A desired also had to factor in lack of equipment or supplies due to a need to reduce weight and bulk for operators who had to carry most or all of their equipment. The need to avoid "damaging" the CDs taught away from compressive forces used for coupling or snag hazards which would conceivably cause the CDs to break and leak or break an internal glass structure that carries one of the combinant chemiluminescent chemicals which, after breaking, generate light due to chemical reactions of the binary substances in the other and inner fluid containers where the inner container is a breakable item. Eventually, the inventors thought about how to connect the caps with the light ends in such a way that did not break the exemplary CDs. This inventive effort required experimentation and use of different designs to eventually come up with a surprising result which was that a compressive cap with self-tapping threads could cut into the CDs structure without breaking the outer housing or inner glass or breakable structure and still have enough coupling effect to prevent the CDs from being ripped out of their tactile identification structure or cap without significant force or un-intentionally fall off based on various interactions of an operator with their environment or the tactile identification structures or caps. Trial and error where used with additive manufacturing systems until a size of thread was found.

Moreover, it was further found that if the thread heights were too tall, it was impossible to screw onto the CDs using human or manual force without mechanical assistance such as tools. If too small, then the threads would not "bite" and hold. An operator in this context would not wish to carry additional tools to apply force beyond that which not only a human could apply but could easily break the CD's outer case or break an internal capsule of chemical or chemiluminescent reaction fluid.

Another set of embodiments are directed to how to rapidly couple structures associated with the invention with existing communication or signaling systems such as different CDs. For example, an embodiment includes forming a tactile identification or structure cap with self-tapping or self-threading rifling or threading which "bites" into the CD end without breaking the CD internal structures but threadably securing the tactile identification structure or cap to an end of the exemplary CD so these tactile identification structures or caps can be re-used and re-loaded. Such self-tapping or threading designs avoid a need for glue or adhesives or other coupling structures and thereby reduce items that an operator needs to carry into the field to make use of at least some embodiments of the invention.

In an exemplary embodiment, examples of various invention design and manufacturing start with creation of a computer aided design (CAD) that includes a top and bottom cap to hold an exemplary CD and loop or attach point for a coupling structure such as an elastic cord. An exemplary design includes with an ability to mount to various places on a uniform. In other examples a design can include an, e.g., 5 inch elastic cord or zip tie or loop for a with a connection and rapid release connection method for top or bottom pieces such as having an attachment, e.g., eyelet, structure in either an exemplary CD or a protrusion from a bottom or top section of an exemplary tactile identification structure or cap. which is designed to enable an operator to carry a number of these CDs on the cord, zip tie, or loop until a user or operator wishes to employ them; at that point, the operator or user uses feel or tactile structures of at least one set of embodiments of the invention to distinguish between the various CDs having different light or IR emission colors or spectrums with differently shaped tactile identification structures or caps, finding the tactile identification structure or cap associated with a particular spectrum or color, then ripping the CD from the loop, zip tie, or the cord by applying force to the CD and thereby ripping or tearing the eyelet or cord, tie, loop, or plurality of CD coupling structure in the cap or the CD body; and then moving the CD into an employment position to thereby use or place the CD. Embodiments can include different shapes on the exemplary tactile cap to correlate each shape with a certain CD or light frequencies or communication/signaling capability emitted by a particular communication or signaling (e.g., lighting) system having similar or identically shaped outer structures.

Another advantage of various embodiments of tactile identification structures or caps include cases where they can be produced in a field or remote operating locations via manufacturing methods which are highly mobile or portable. Examples include using of design elements or manufacturing influenced design thinking that enables near or at point of use manufacturing.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
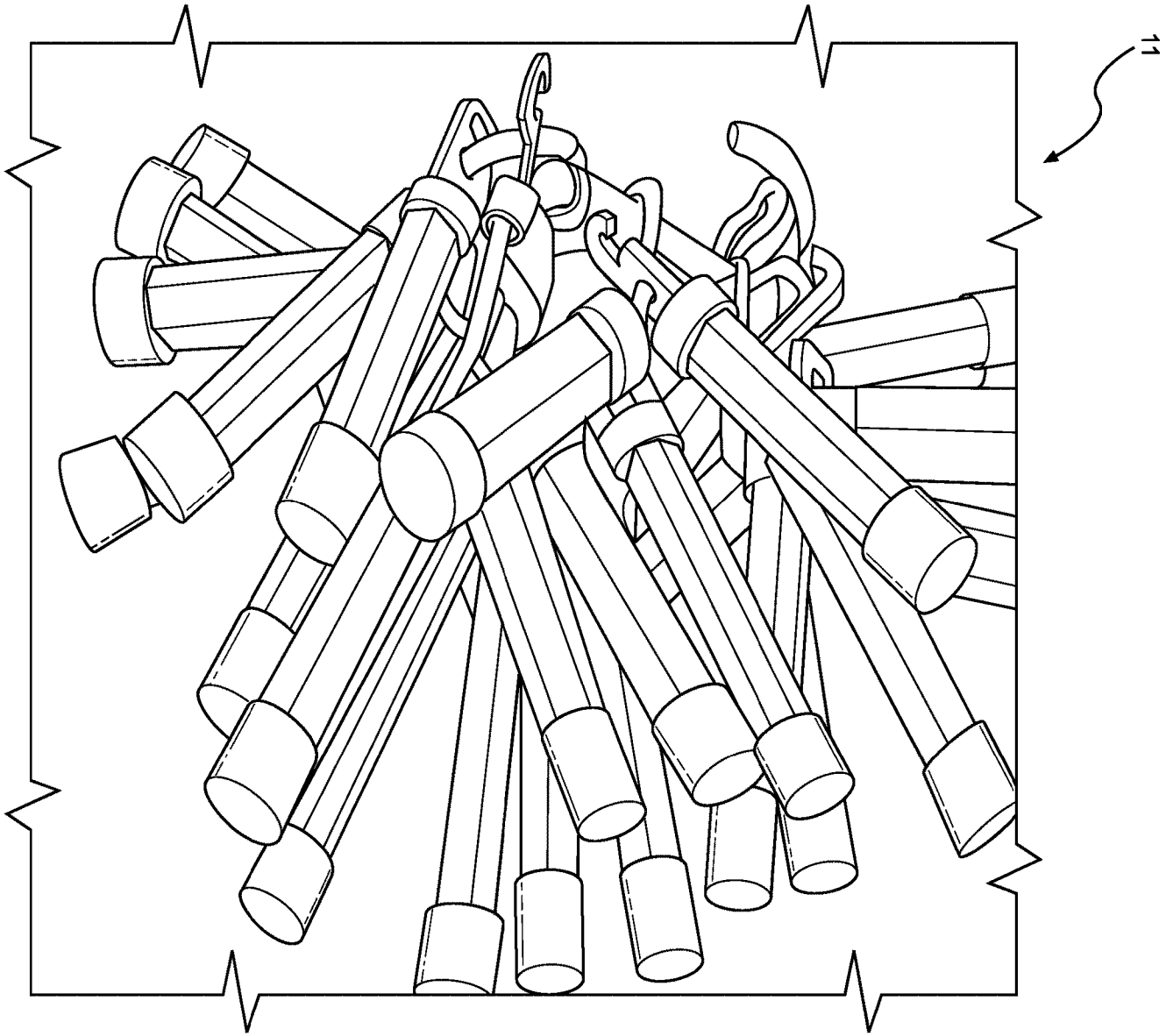
FIG. 1 (Prior Art)
FIG. 1 shows a view of a collection of similarly shaped set of CDs which appear to be the same even though they emit different colors or frequencies and therefore are difficult to distinguish one from another.

The embodiments of the invention described herein are not intended to be exhaustive or to limit the invention to precise forms disclosed. Rather, the embodiments selected for description have been chosen to enable one skilled in the art to practice the invention.

Generally, provided is a method of configuring, loading, selecting, and employing one of a number of visual, near-infrared, or infrared emitters from a plurality of such emitters using tactile sensory based emitter selection or identification structures comprising: selecting a plurality of electromagnetic frequencies to communicate, mark, designate, or indicate (CMDI), wherein said selected electromagnetic frequencies comprise electromagnetic energy within visual, near-infrared, or infrared spectrum, wherein each of said selected electromagnetic frequencies is associated with a marking, communicating, designating, identifying action; providing a mobile storage or employment structure comprising attachment or storage structures comprising a vest or garment with pockets or loop attachment structures; providing a plurality CMDI systems that respectively emits electromagnetic emissions within one frequency range falling within said selected visual, near-infra-red, or infrared spectrum, wherein each of CMDI system comprises: a chemiluminescent device (CD) that emits said electromagnetic emissions within said one frequency range, wherein said CD is further formed with a first end and a second end, wherein the CD is formed with a breakable internal vessel comprising a first liquid, wherein the CD is further formed with a flexible outer housing that is further filled with a second liquid, wherein the first and second liquid when combined after flexing of the flexible outer housing and breakage of the breakable internal vessel form a chemiluminescent compound or mixture that emits one of a plurality of visual, near-infra-red, or infrared spectrum light emissions, wherein the second end is formed with an CD attachment section formed with at least an CD attachment section aperture and hook structure, wherein the CD attachment section extends away from the CD body; a case formed to receive a portion of the CD that is formed with a quick release structure comprising a tear strip or coupler that enables the case to be quickly removed wherein the case is formed to block light emissions from the CD until removed; a tactile selection structure comprising: a first cap formed with a tactile selection shape, wherein the first cap has a first and second cap end opposing said first cap end, said first cap end is further formed with a first cylindrical section with enclosing walls and having a first open end that is formed so that one end of said case inserts into said first open end, wherein said first cap is formed with a one of a plurality of said tactile sensory based emitter selection or identification structures comprising a square, a pyramid, cylinder, and rounded shapes, wherein the first cap is formed with a first set of self-tapping internal threads adapted to grip or cut into said first end of the CD; a second cap formed with internal threads formed with a second set of self-tapping internal threads adapted to grip or cut into the second end of CD, wherein the second end cap is further formed with an end cap aperture that is adapted to receive and allow the CD attachment section to protrude from so that the CD body attachment aperture is not covered by the second cap; a first and second lanyard connection section respectively formed into the first and second cap; and an elastic line, wherein a first end of the elastic line is coupled with said first lanyard connection section and a second end of the elastic line is coupled with the second lanyard connection section, wherein said elastic line is formed with a length that applies a first elastic compressive force pulling the first second caps together; coupling together a plurality of the CMDIs that emit different ones of said plurality of visual, near infrared, or infrared spectrum light emissions by passing a cord or loop through all of said CD attachment section apertures then coupling the cord or loop to a section of the mobile storage system or employment structure; donning gloves and moving into a low or no light area with the CMDIs; identifying one of said CMDI actions associated with a respective one of said plurality of said tactile sensory based emitter selection or identification structures; selecting one of said plurality of the CMDI systems with a respective said first cap formed with said respective one of said plurality of tactile sensor based selection or identification structures; and withdrawing and activating said selected one of said CMDI systems from the mobile storage system or employment structure by ripping the CMDI system from the cord or loop that is coupled to the mobile storage system or employment structure and thereby tearing or opening a portion of the CD attachment section to allow the cord or loop to pass from an affected CD attachment section aperture; and placing, coupling, or moving the selected and activated one of said CMDI systems in in accordance with a selected one of said CDMI actions; wherein at least some said plurality of CMDI systems have at least two or more different tactile sensory based emitter selection or identification structures comprising a square, a pyramid, cylinder, or rounded shapes; wherein said plurality of CMDI systems are grouped together and attached to said mobile storage or employment structure; wherein at least the first cap's the first cylindrical section's enclosing walls are formed with a wall thickness and material section that require a first force to screw the first cap onto the first end of the CD without rupturing the first end of the CD or tearing or splitting the first cylindrical section's enclosing walls, wherein said first force is no more than ten inch pounds of torque; wherein the first and second caps are formed with a material than is harder than the first end of the CD, wherein the first end of the CD is formed of a plastic material that deforms or is cut into when the first end cap is screwed on the first end of the CD but does not rupture the CD structure.

In an illustrative embodiment, the thickness of the first and second end caps is not less than 1/16th of an inch when manufacturing the end caps with ABS or PLA produced with an additive manufacturing process. In an illustrative embodiment, the CMDI actions comprise placing the CD at a location that is within a field of view of an observer, throwing the CD with respect to a target location, coupling the CD with an object, or moving the CD with respect to field of view observable from an external observation point or points to attract attention of an observer at the external observation point or points.

In an illustrative embodiment, provided is a method of configuring, loading, selecting, and employing one of a number of visual, near-infrared, or infrared emitters from a plurality of such emitters using tactile sensory based emitter selection or identification structures comprising: selecting a plurality of electromagnetic frequencies to communicate, mark, designate, or indicate (CMDI), wherein each of said selected electromagnetic frequencies is associated with a CDMI action; providing a plurality CMDI systems that respectively emits electromagnetic emissions within one frequency range falling within said selected visual, near-infra-red, or infrared spectrum, wherein each of CMDI system comprises: a chemiluminescent device (CD) that emits said electromagnetic emissions within said one frequency range, wherein said CD is further formed with a first end and a second end, wherein the CD is formed with a breakable internal vessel comprising a first liquid, wherein the CD is further formed with a flexible outer housing that is further filled with a second liquid, wherein the first and second liquid when combined after flexing of the flexible outer housing and breakage of the breakable internal vessel form a chemiluminescent compound or mixture that emits one of a plurality of visual, near infrared, or infrared spectrum light emissions, wherein the second end is formed with an CD attachment section formed with at least an CD attachment section aperture and hook structure, wherein the CD attachment section extends away from the CD body, wherein each of said selected electromagnetic frequencies associated with a CDMI action is further associated with respective ones of said plurality of visual, near infrared, or infrared spectrum light emissions from each of said CDMI systems; a tactile selection structure comprising: a first cap formed with a tactile selection shape, wherein the first cap has a first and second cap end opposing said first cap end, said first cap end is further formed with a first cylindrical section with enclosing walls and having a first open end that is formed so that one end of said case inserts into said first open end, wherein said first cap is formed with a one of a plurality of said tactile sensory based emitter selection or identification structures comprising a square, a pyramid, cylinder, and rounded shapes; coupling together a plurality of the CMDIs that emit different ones of said plurality of visual, near infrared, or infrared spectrum light emissions; identifying one of said communication actions associated with a respective one of said plurality of said tactile sensory based emitter selection or identification structures; selecting one of said plurality of the CMDIs with a respective said first cap formed with said respective one of said plurality of tactile sensor based selection or identification structures; and withdrawing and activating said selected one of said CMDIs from the mobile storage system or employment structure; placing, coupling, or moving the selected and activated one of said CMDI systems in in accordance with a selected one of said CDMI actions; wherein at least some said plurality of CMDI systems have at least two or more different tactile sensory based emitter selection or identification structures comprising a square, a pyramid, cylinder, or rounded shapes wherein at least the first cap's the first cylindrical section's enclosing walls are formed with a wall thickness and material section that require a first force to screw the first cap onto the first end of the CD without rupturing the first end of the CD or tearing or splitting the first cylindrical section's enclosing walls, wherein said first force is no more than ten inch pounds of torque; wherein the first and second caps are formed with a material than is harder than the first end of the CD, wherein the first end of the CD is formed of a plastic material that deforms or is cut into when the first end cap is screwed on the first end of the CD but does not rupture the CD structure.

In an illustrative embodiment, the method further includes providing a mobile storage or employment structure comprising attachment or storage structures comprising a vest or garment with pockets or loop attachment structures; and coupling the cord or loop to a section of the mobile storage system or employment structure. In an illustrative embodiment, the selected electromagnetic frequencies comprise electromagnetic energy within visual, near-infrared, or infrared spectrum. In an illustrative embodiment, the at least one CMDI system further comprises a case formed to receive a portion of the CD that is formed with a quick release structure comprising a tear strip or coupler that enables the case to be quickly removed wherein the case is formed to block light emissions from the CD until removed. In an illustrative embodiment, the first cap is formed with a first set of self-tapping internal threads adapted to grip or cut into said first end of the CD. In an illustrative embodiment, the at least one CDMI system further comprises: a second cap formed with internal threads formed with a second set of self-tapping internal threads adapted to grip or cut into the second end of CD, wherein the second end cap is further formed with an end cap aperture that is adapted to receive and allow the CD attachment section to protrude from so that the CD body attachment aperture is not covered by the second cap; a first and second lanyard connection section respectively formed into the first and second cap; and an elastic line, wherein a first end of the elastic line is coupled with said first lanyard connection section and a second end of the elastic line is coupled with the second lanyard connection section, wherein said elastic line is formed with a length that applies a first elastic compressive force pulling the first second caps together. In an illustrative embodiment, the method further comprises removing the second cap from the CD. In an illustrative embodiment, the withdrawing and activating said selected one of said CMDIs from the mobile storage system or employment structure comprises ripping the CMDI from the cord or loop that is coupled to the mobile storage system or employment structure and thereby tearing or opening a portion of the CD attachment section to allow the cord or loop to pass from an affected CD attachment section aperture. In an illustrative embodiment, coupling together a plurality of the CMDIs that emit different ones of said plurality of visual, near infrared, or infrared spectrum light emissions comprises passing a cord or loop through all of said CD attachment section apertures.

In an illustrative embodiment, provided is a signaling and communication device, comprising: a chemiluminescent device (CD) that emits electromagnetic emissions within one frequency range, wherein said CD is further formed with a first end and a second end, wherein the CD is formed with a breakable internal vessel comprising a first liquid, wherein the CD is further formed with a flexible outer housing that is further filled with a second liquid, wherein the first and second liquid when combined after flexing of the flexible outer housing and breakage of the breakable internal vessel form a chemiluminescent compound or mixture that emits one of a plurality of visual, near-infra-red, or infrared spectrum light emissions, wherein the second end is formed with an CD attachment section formed with at least an CD attachment section aperture and hook structure, wherein the CD attachment section extends away from the CD body; a case formed to receive a portion of the CD that is formed with a quick release structure comprising a tear strip or coupler that enables the case to be quickly removed wherein the case is formed to block light emissions from the CD until removed; a tactile selection structure comprising: a first cap formed with a tactile selection shape, wherein the first cap has a first and second cap end opposing said first cap end, said first cap end is further formed with a first cylindrical section with enclosing walls and having a first open end that is formed so that one end of said case inserts into said first open end, wherein said first cap is formed with a one of a plurality of said tactile sensory based emitter selection or identification structures comprising a square, a pyramid, cylinder, and rounded shapes; a first and second lanyard connection section respectively formed into the first and second cap; and an elastic line, wherein a first end of the elastic line is coupled with said first lanyard connection section and a second end of the elastic line is coupled with the second lanyard connection section, wherein said elastic line is formed with a length that applies a first elastic compressive force pulling the first second caps together.

In an illustrative embodiment, a thickness of the first and second end caps is not less than 1/16th of an inch when manufacturing the end caps with ABS or PLA produced with an additive manufacturing process. In an illustrative embodiment, the first cap is formed with a first set of self-tapping internal threads adapted to grip or cut into said first end of the CD; wherein the second cap formed with internal threads formed with a second set of self-tapping internal threads adapted to grip or cut into the second end of CD; and wherein the second end cap is further formed with an end cap aperture that is adapted to receive and allow the CD attachment section to protrude from so that the CD body attachment aperture is not covered by the second cap.

FIG. 1 shows a view of a collection of similarly shaped set of CDs 11 which appear to be the same even though they emit different colors or frequencies and therefore are difficult to distinguish one from another. The bundle of CDs 11 appear to be the same externally particularly in low or no visibility conditions such as dark conditions. These bundles of CDs 11 are not easy to identify or select one of a particular color or emissive type.

Figure 2:
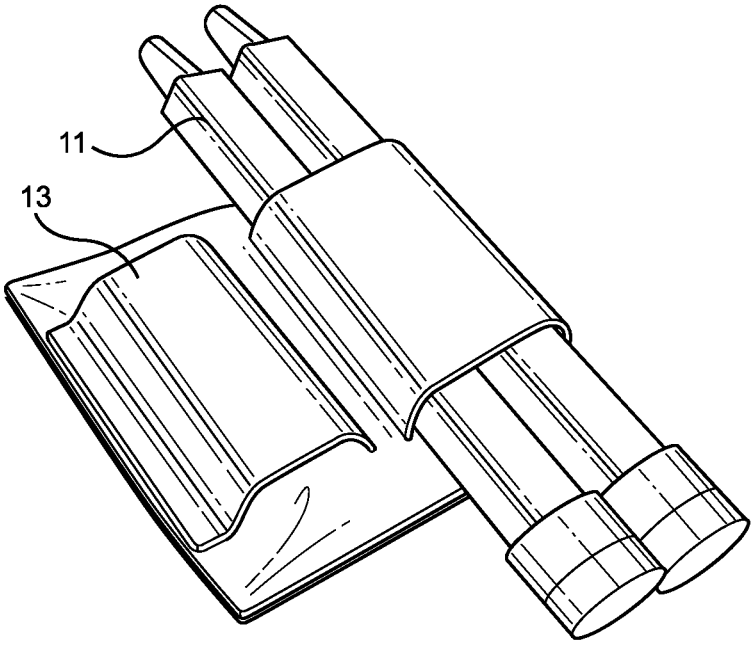
FIG. 2 (Prior Art)
FIG. 2 shows an exemplary set of IR frequency CDs within a small fabric carrying structure that both appear to be the same but may not actually emit the same frequency of IR spectrum emissions.

FIG. 2 shows an exemplary set of IR frequency CD 11 within a small fabric carrying structure 13 that both appear to be the same but may not actually emit the same frequency of IR spectrum emissions. Again, these CDs 11 appear the same and therefore are not easily distinguishable from another.

Figure 3:
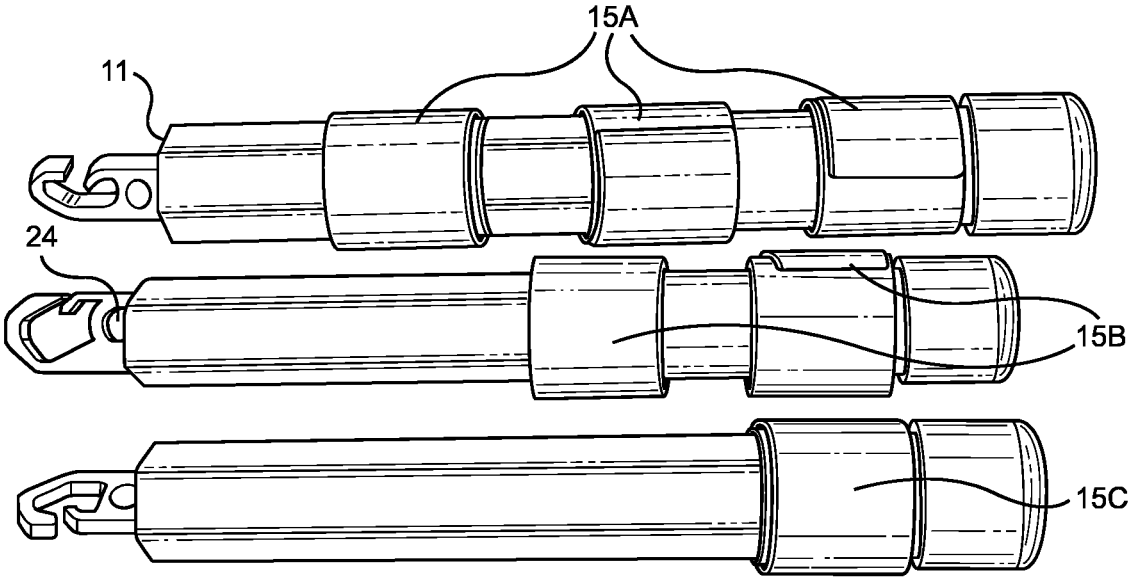
FIG. 3 (Prior Art)
FIG. 3 shows three exemplary IR frequency CDs with different tape sections which have been used in an attempt to distinguish between different IR CDs with different frequency emissions.

FIG. 3 shows three exemplary IR frequency CDs 11 with different tape sections 15A, 15B, 15C, which have been used in an attempt to distinguish between different IR CDs with different frequency emissions. In this example, three tape segments 15A are coupled to an IR CD 11; two tape segments 15B are coupled to another CD 11; one tape segment 15C is coupled to another IR CD 11. These tape segments 15A-15C are not easily seen or seeable at all in low or no visibility conditions and therefore an operator would have serious difficulty in selecting a particular one of the CDs 11.

Figure 4:
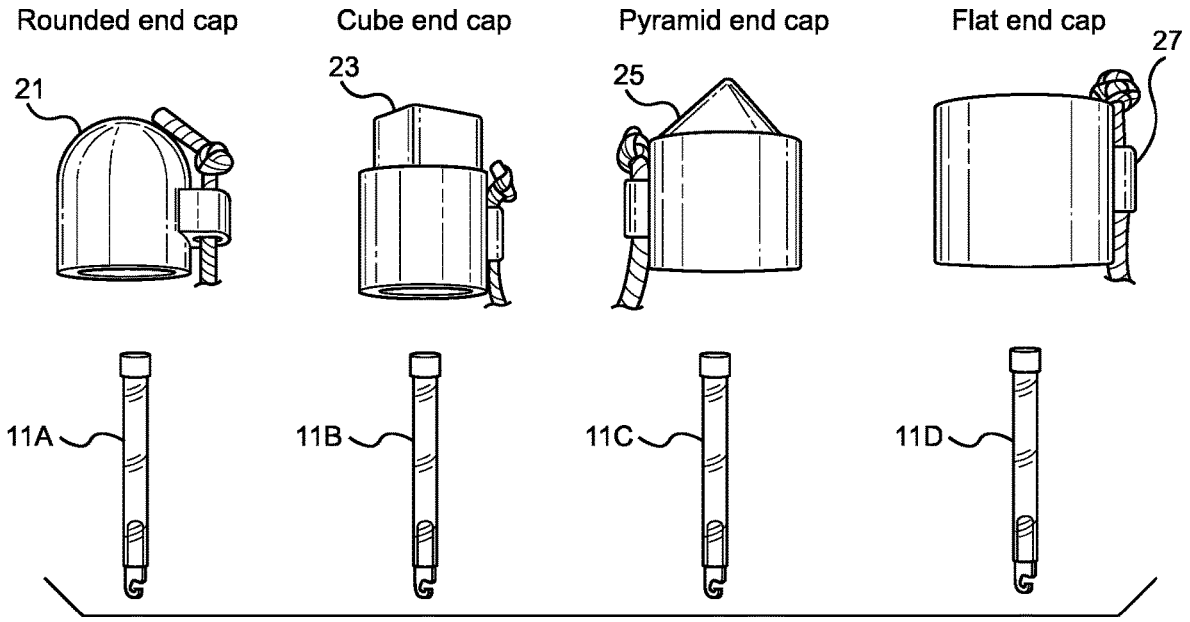
FIG. 4 shows a set of exemplary set of tactile identification cap structures having different shaped structures which are used with one or more exemplary communication, signaling, or identification methods that are used with a signaling, communication, identification or action request system such as CDs associated with specific or different light frequencies or colors.

FIG. 4 shows a set of exemplary set of tactile identification cap structures 21, 23, 25, 27 having different shaped structures (e.g., rounded, cube, pyramid, flat end) which are used with one or more exemplary communication, signaling, or identification methods employing CDs 11A (red), 11B (green), 11C (blue), 11D (IR).

Figure 5:
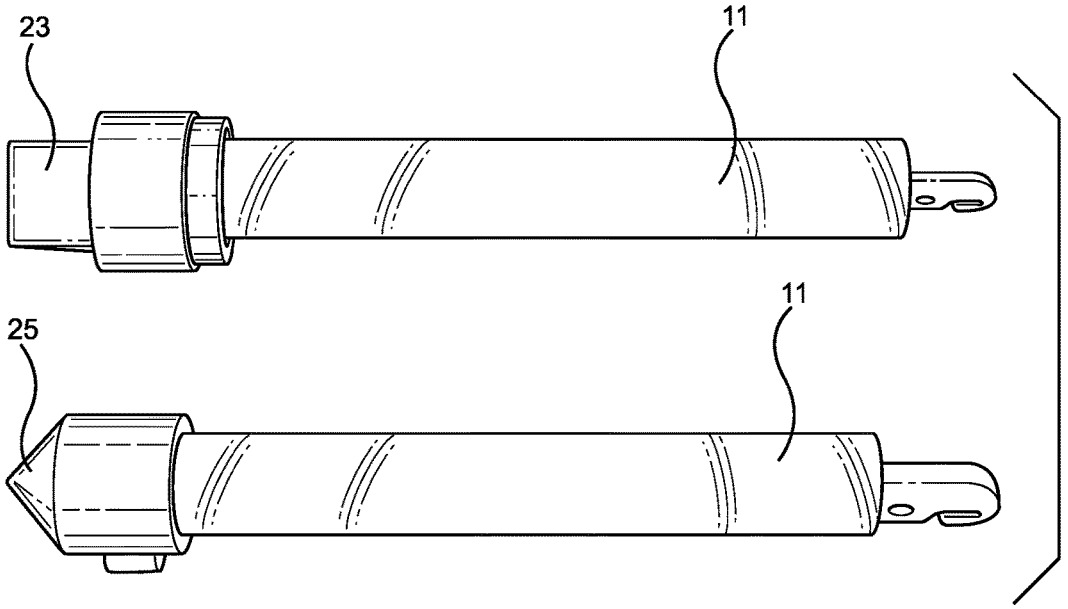
FIG. 5 shows another view of set of exemplary set of tactile identification cap structures having different shaped structures which are used with one or more exemplary communication, signaling, or identification methods.

FIG. 5 shows another view of set of 11 systems with exemplary set of tactile identification cap structures 23, 25 having different shaped structures which are used with one or more exemplary communication, signaling, or identification methods. One cap 23 is formed as a slot or wall shaped structure and the other cap 25 is formed in a pointed shape or pyramid shape.

Figure 6:
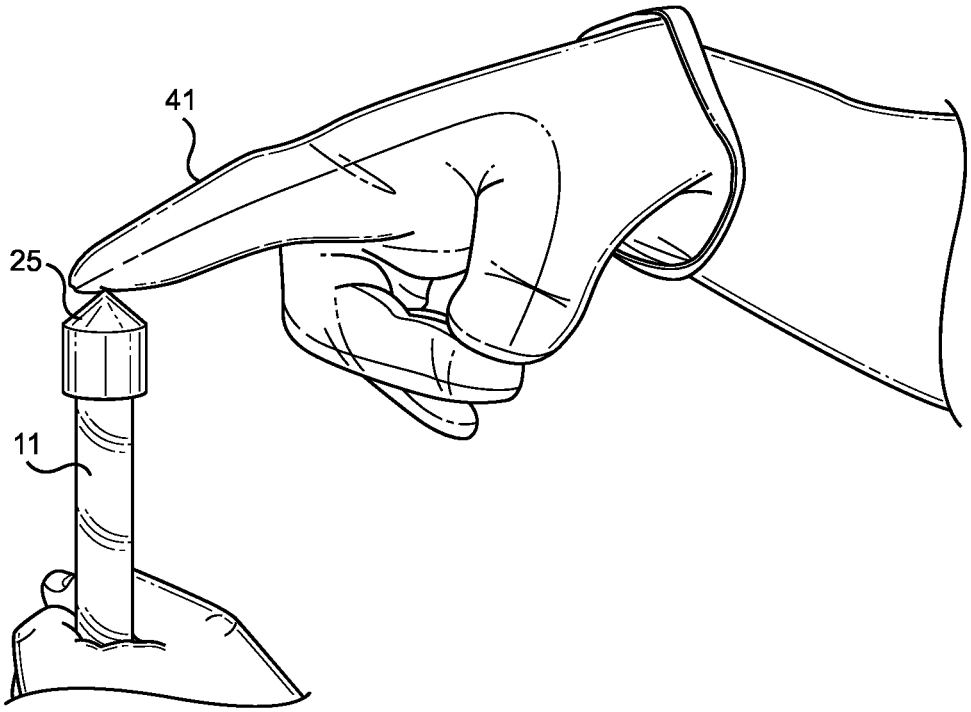
FIG. 6 shows a view of a tactile identification cap structure with an exemplary tactile identification shape with a user demonstrating touching the tactile identification structure and thereby associating the tactile identification structure shape with a particular light frequency of an exemplary CDs coupled with the tactile identification structure.

FIG. 6 shows a view of a tactile identification cap structure 25 (pointed e.g., cone or pyramid structure) with an exemplary tactile identification shape. This figure shows a user demonstrating touching the tactile identification structure or cap 25 with a glove 41 and thereby associating the tactile identification structure shape with a particular light frequency of an exemplary CD coupled with the tactile identification structure 25.

Figure 7A:
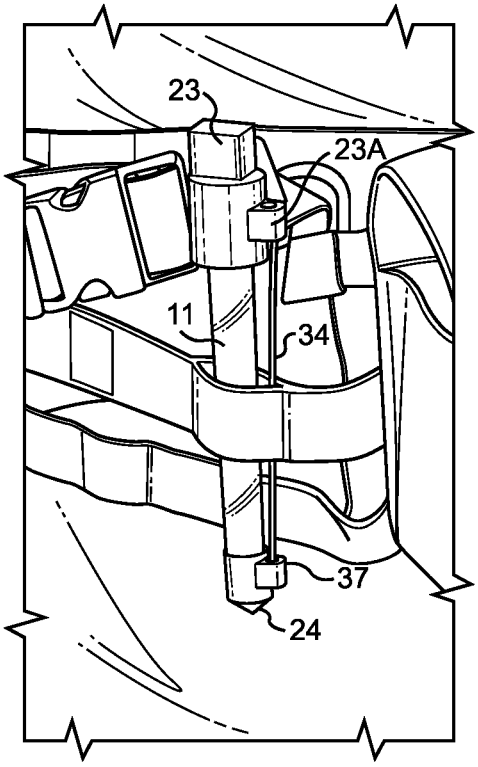
FIG. 7A shows a close-up side view of a user with one embodiment of a tactile identification cap with retaining structures coupled with an exemplary CD system attached to a user's personal gear (e.g. a tactical vest with loop structures).
Figure 7B:
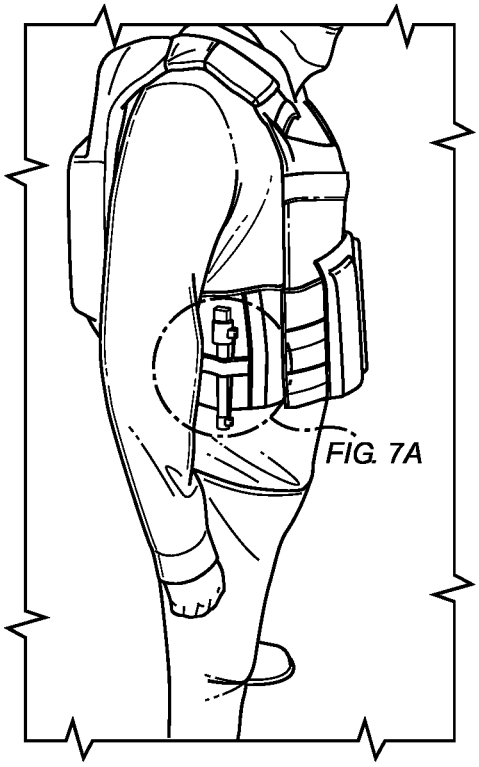
FIG. 7B shows a perspective view of the FIG. 7A view with a wider perspective.

FIG. 7A shows a close-up side view of a user with one embodiment of a tactile identification cap 23 with retaining structures 34, 37 coupled with an exemplary CD 11 or lighting system attached to a user's personal gear (e.g. a tactical vest with loop structures). FIG. 7B shows a perspective view of the FIG. 7A view with a wider perspective.

Figure 8:
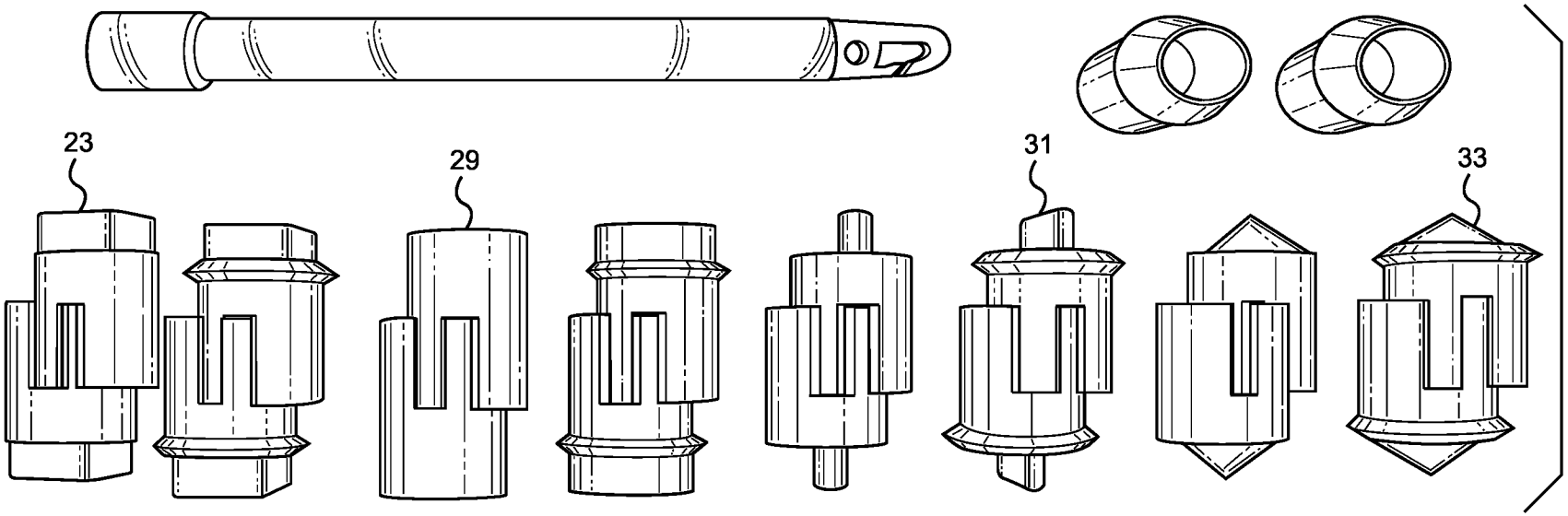
FIG. 8 shows a number of exemplary tactile identification structures with different shapes which enable a user to quickly distinguish between different shapes of each tactile identification structure.

FIG. 8 shows a number of exemplary tactile identification structures 23-33 with different shapes (block 23, circular 29, slot 31, pointed or cone structure 33) which enable a user to quickly distinguish between different shapes of each tactile identification structure.

Figure 9:
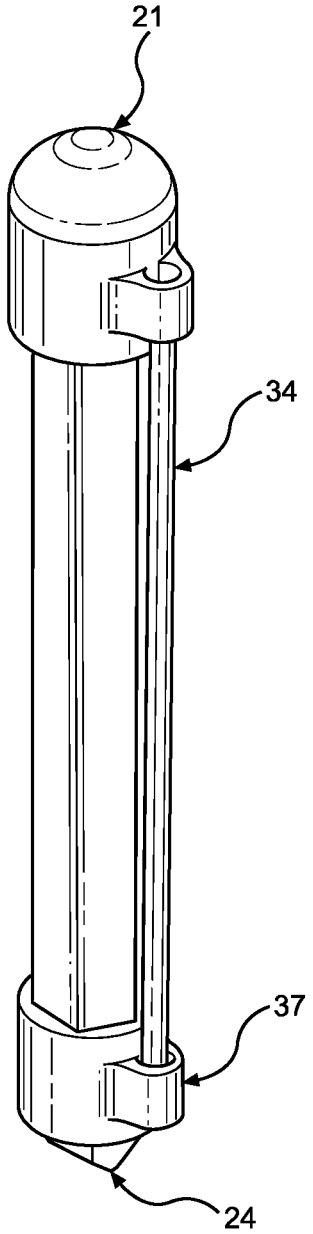
FIG. 9 shows a perspective view of one embodiment of a tactile identification structure or cap with a retaining structures including a retaining structure attachment coupler and elastic lanyard or cord that collectively couples with an exemplary CD system.

FIG. 9 shows a perspective view of one embodiment of a tactile identification cap 21 with retaining structures including a second cap 37 and elastic lanyard or cord 34 coupled with an exemplary CD or light system. The second cap 37 is attached on an opposing end of the CD light structure 11. A coupling or attachment point 24 is formed on one end of the CD 11 that extends away from the CD 11. The elastic lanyard or cord 34 pulls the tactile identification cap 21 towards the second cap 37 therefore applies a pulling force to keep the two caps 21, 37 together on the CD 11.

Figure 10A:
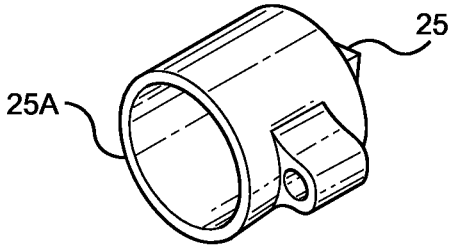
FIGS. 10A, 10B, and 10C show perspective views of different tactile identification structures or caps having different shapes that enable rapid tactile identification and distinguishing between different tactile identification or end caps.
Figure 10B:
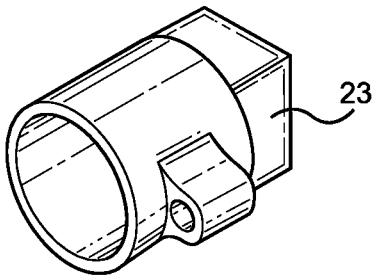
Figure 10C:
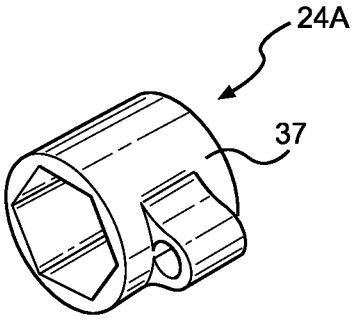

FIGS. 10A, 10B, and 10C show perspective views of different tactile identification caps 35, 23, having different shapes (cone, square or block) that enable rapid tactile identification and distinguishing between different end caps. An end cap 37 is also shown. These figures show a perspective view showing an opening, e.g., 25A that a CD is inserted into. A FIG. 9 second cap 37 is shown with an opening that an IR CD insert into. A second opening is formed in the second cap 37, which allows a coupling or attachment structure to pass out of the second cap 37 (opening is not viewable from this perspective).

Figure 11:
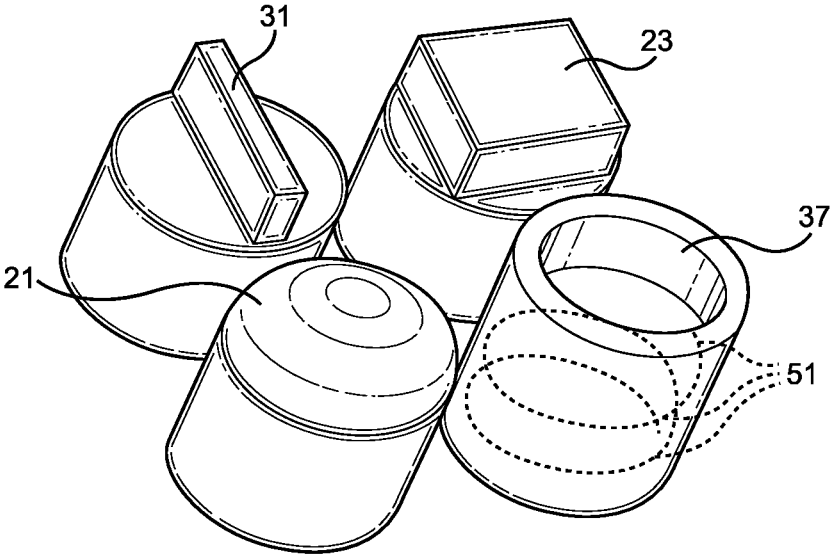
FIG. 11 shows another exemplary embodiment with another exemplary attachment structure (internal threads within an exemplary tactile identification cap cavity).
Figure 12:
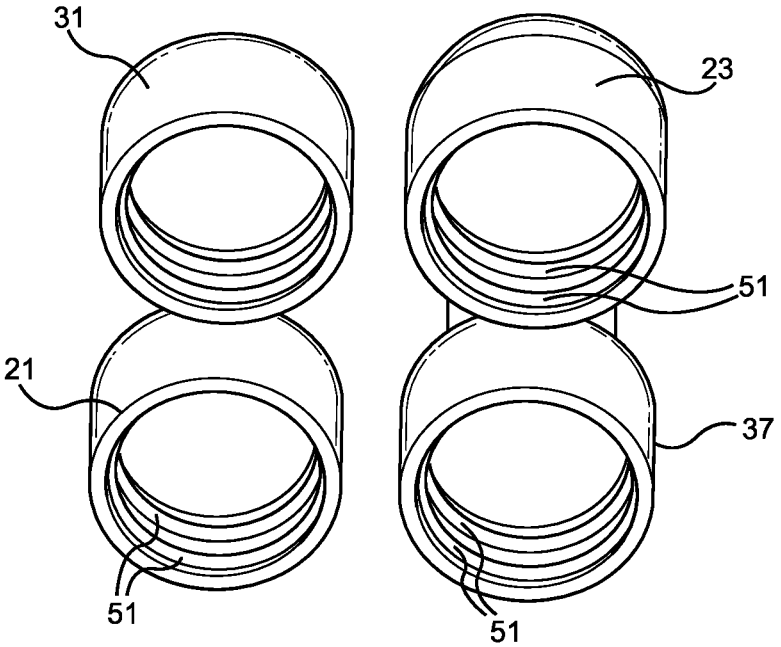
FIG. 12 shows another view of the FIG. 11 exemplary embodiments showing an internal view of the exemplary end caps and their internal threads which are used to couple with exemplary CDs.
Figure 13:
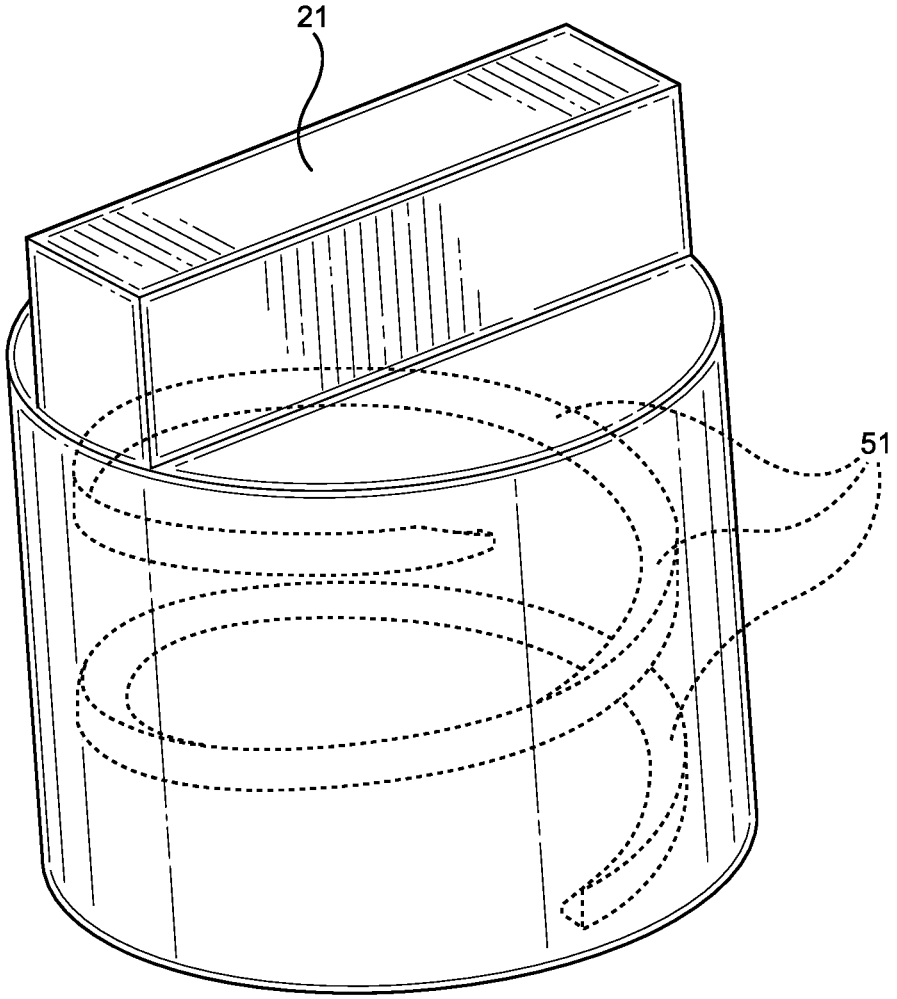
FIG. 13 shows a detail view showing an exemplary tactile identification structure or cap with internal thread structure denoted by ghost lines.

FIG. 11 shows another set of exemplary embodiments 21, 23, 31 with another exemplary attachment structure (internal threads 51) within an exemplary tactile identification structure or cap's cavity. FIG. 12 shows another view of the FIG. 11 exemplary embodiments 21, 23, 31, etc. showing an internal view of the exemplary tactile identification structures or end caps and their internal threads 51 which are used to couple with exemplary CDs. This view also shows the second cap 37 that has internal threads 51. FIG. 13 shows a detail view showing an exemplary internal thread structure 51 with ghost lines of an exemplary tactile identification structure or end cap 21.

Figure 14A:
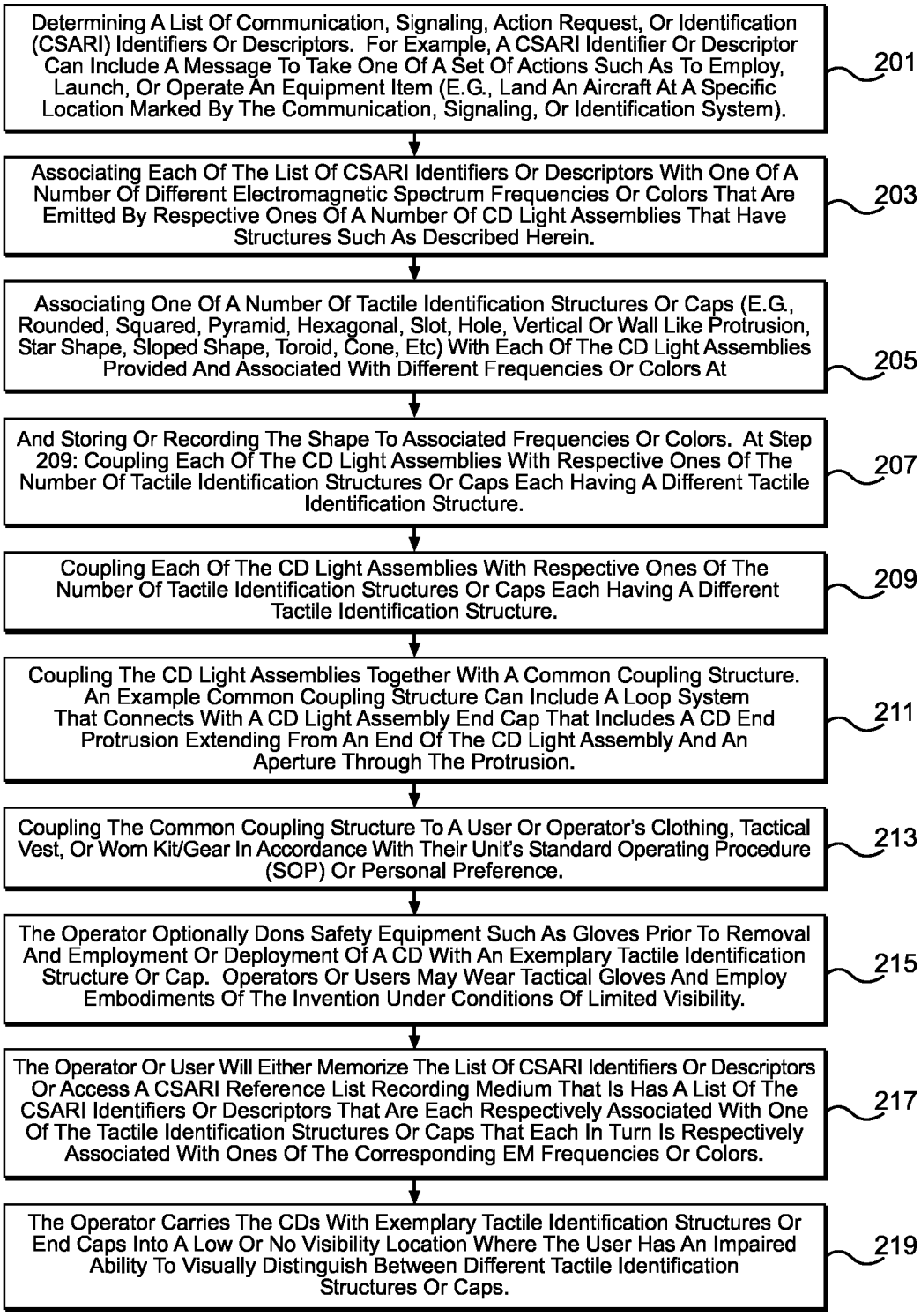
FIGS. 14A and 14B show an exemplary method in accordance with one embodiment of the invention.
Figure 14B:
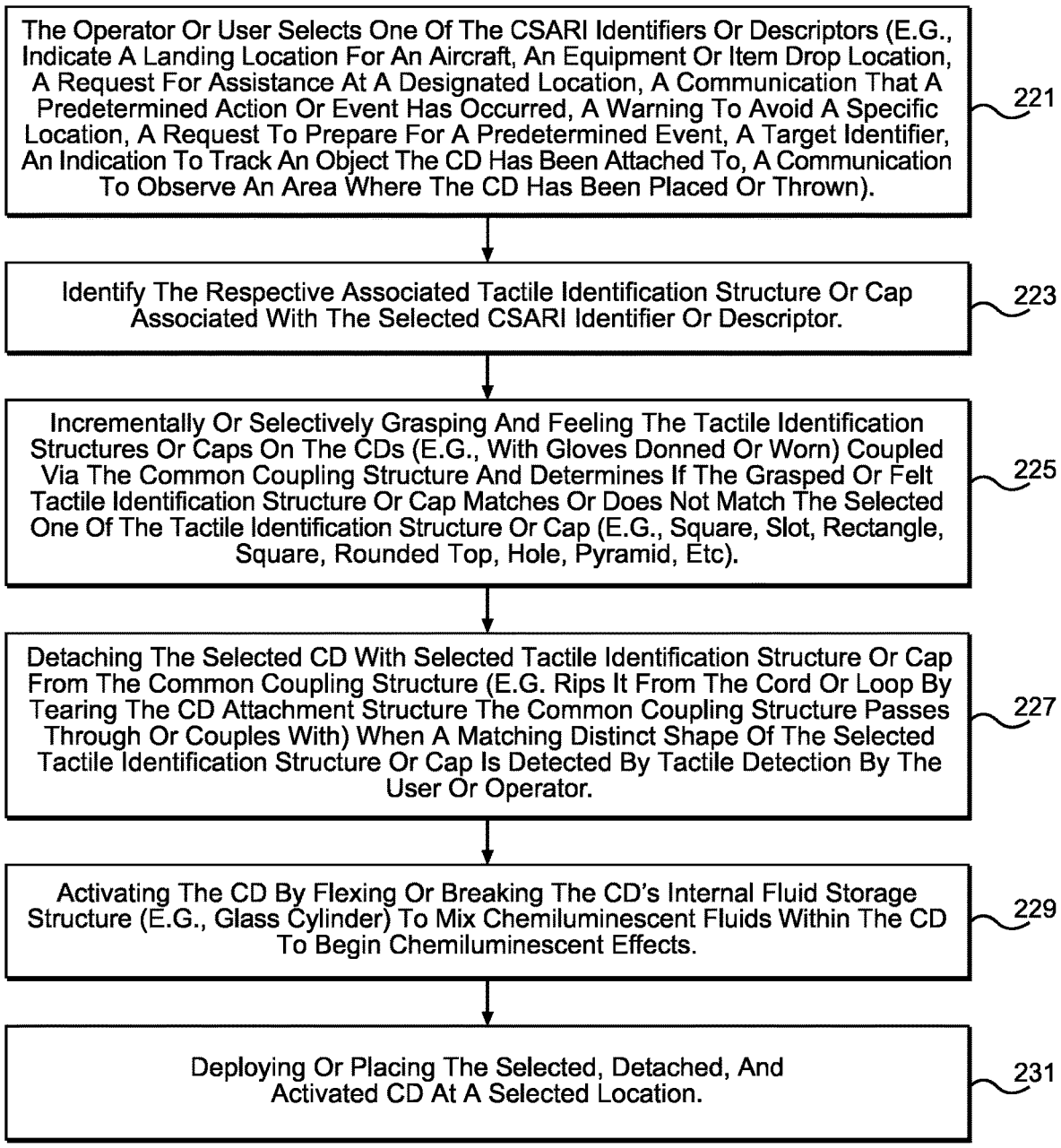

FIGS. 14A and 14B generally show a method of providing or building, selecting, and employing an exemplary communication, signaling, action request, or identification system that is selected by a user based on non-visual or tactile selection by a user. In at least some examples, a user can be equipped with safety equipment, which may include gloves, which are worn during tactile selection of an exemplary CD system with an exemplary tactile identification structure or cap. At Step 201: determining a list of communication, signaling, action request, or identification (CSARI) identifiers or descriptors. For example, a CSARI identifier or descriptor can include a message to take one of a set of actions such as to employ, launch, or operate an equipment item (e.g., land an aircraft at a specific location marked by the communication, signaling, or identification system). At Step 203, a next step can include associating each of the list of CSARI identifiers or descriptors with one of a number of different electromagnetic spectrum frequencies or colors that are emitted by respective ones of a number of CD light assemblies that have structures such as described herein. At Step 205: associating one of a number of tactile identification structures or caps (e.g., rounded, squared, pyramid, hexagonal, slot, hole, vertical or wall like protrusion, star shape, sloped shape, toroid, cone, etc) with each of the CD light assemblies provided and associated with different frequencies or colors at Step 207 and storing or recording the shape to associated frequencies or colors. At Step 209: coupling each of the CD light assemblies with respective ones of the number of tactile identification structures or caps each having a different tactile identification structure. For example, one exemplary embodiment can include forming threads in the tactile identification structures or caps which are dimensioned and formed from a material that grips or engages with an end section of a respective CD light assembly such that the tactile identification structures or caps' threads have an interference fit with or cut into the CD end sections. Each exemplary tactile identification structures or caps are coupled, for example, with an end of the exemplar CDs using a number of coupling structures. For example, an embodiment can include a coupling structure that secures the structures or caps to a respective CD by means of an elastic cord which is coupled with a retainer cap or cord mount that fits onto on an opposing end of the CD that has a flange that couples with the elastic cord. In some embodiments, the retainer cap or cord mount can have an aperture to allow a CD mounting or coupling structure to pass through an aperture in the retainer cap or cord mount. Alternative embodiments can use an adhesive or another screw or threaded structure within the cap or cord mount that bites in to the CD. Other exemplary embodiments can include tactile identification structures or caps as well as retainer cap or cord mount that snugly fits onto opposing ends of an exemplar CD and is drawn together by the elastic cord that is coupled to the tactile identification structures or caps and the retainer cap or cord mount with a length that draws applies a pulling force on both the tactile identification structures or caps and the retainer cap or cord mount to keep them coupled to a respective CD. Exemplary tactile identification structures or caps can be provided either as an add-on device that secures to the top of a respective CD or as a design change to the structural manufacturing of a CD outer case. At Step 211: coupling the CD light assemblies together with a common coupling structure. An example common coupling structure can include a loop system that connects with a CD light assembly end cap that includes a CD end protrusion extending from an end of the CD light assembly and an aperture through the protrusion. At Step 213: coupling the common coupling structure to a user or operator's clothing, tactical vest, or worn kit/gear in accordance with their unit's standard operating procedure (SOP) or personal preference. In at various exemplary embodiments or methods, each different CD or tactical light design emits a different light frequency or color to include visible and/or IR. At Step 215: The operator optionally dons safety equipment such as gloves prior to removal and employment or deployment of a CD with an exemplary tactile identification structure or cap. Operators or users may wear tactical gloves and employ embodiments of the invention under conditions of limited visibility. At Step 217: the operator or user will either memorize the list of CSARI identifiers or descriptors or access a CSARI reference list recording medium that is has a list of the CSARI identifiers or descriptors that are each respectively associated with one of the tactile identification structures or caps that each in turn is respectively associated with ones of the corresponding EM frequencies or colors. At Step 219: the operator carries the CDs with exemplary tactile identification structures or end caps into a low or no visibility location where the user has an impaired ability to visually distinguish between different tactile identification structures or caps. At Step 221: the operator or user selects one of the CSARI identifiers or descriptors (e.g., indicate a landing location for an aircraft, an equipment or item drop location, a request for assistance at a designated location, a communication that a predetermined action or event has occurred, a warning to avoid a specific location, a request to prepare for a predetermined event, a target identifier, an indication to track an object the CD has been attached to, a communication to observe an area where the CD has been placed or thrown). At Step 223: identify the respective associated tactile identification structure or cap associated with the selected CSARI identifier or descriptor. At step 225: incrementally or selectively grasping and feeling the tactile identification structures or caps on the CDs (e.g., with gloves donned or worn) coupled via the common coupling structure and determines if the grasped or felt tactile identification structure or cap matches or does not match the selected one of the tactile identification structure or cap (e.g., square, slot, rectangle, square, rounded top, hole, pyramid, etc.). At Step 227: detaching the selected CD with selected tactile identification structure or cap from the common coupling structure (e.g. rips it from the cord or loop by tearing the CD attachment structure the common coupling structure passes through or couples with) when a matching distinct shape of the selected tactile identification structure or cap is detected by tactile detection by the user or operator; At Step 229: activating the CD by flexing or breaking the CD's internal fluid storage structure (e.g., glass cylinder) to mix chemiluminescent fluids within the CD to begin chemiluminescent effects. At Step 231: deploying or placing the selected, detached, and activated CD at a selected location. The tactile identification structures or caps can be reused in a training environment. An additional or optional embodiment of an exemplary method can include embodiments of tactile identification structures or caps production and assembly methods where the structures or caps can be produced in a field or remote operating locations via manufacturing methods, which are highly mobile or portable.

Examples include using of design elements or manufacturing influenced design thinking that enables near or at point of use manufacturing. For example, exemplary designs can be manufactured using additive manufacturing equipment as well as other manufacturing equipment, which can be employed from a mobile or highly transportable platform. Material selection also enables such portable or near point of use manufacturing. For example, ABS and PLA can be used which are usable with additive manufacturing with design considerations or factors that result in necessary hardness, cracking/split resistance, toughness, or recognition of design and manufacturing constraints that enable use of various parts with chemical based lighting system case structures (e.g., self-tapping threads that engage with or cut/compress such case structures to provide necessary coupling/gripping or attachment under operational conditions). Densities or thicknesses and layouts of such an additive manufactured design have to be selected or determined to ensure necessary structural integrity of a resulting product (e.g., end cap with threads that self-tap into a CD outer case end) so that the product does not suffer structural failure under anticipated operational use cases or scenarios which can include industrial or high threat/safety/and time sensitive or quick reaction conditions that do not allow for careful handling of equipment as well conditions that can cause impacts or snagging of equipment.

Figure 15:
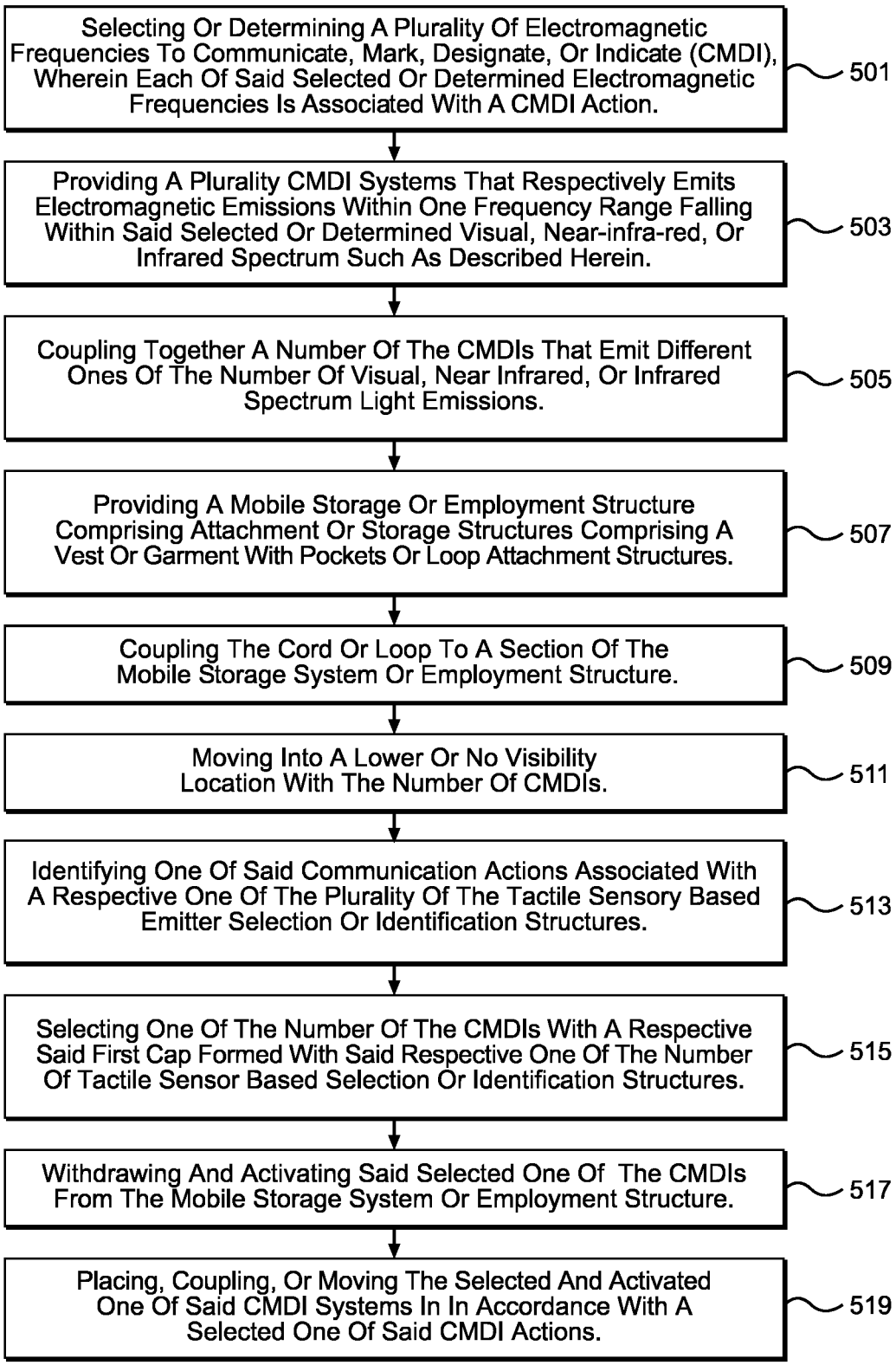
FIG. 15 shows another exemplary method in accordance with another embodiment of the invention.

FIG. 15 shows another exemplary method of configuring, loading, selecting, and employing one of a number of visual, near-infrared, or infrared emitters from a plurality of such emitters using tactile sensory based emitter selection or identification structures. At Step 501: selecting or determining a plurality of electromagnetic frequencies to communicate, mark, designate, or indicate (CMDI), wherein each of said selected or determined electromagnetic frequencies is associated with a CDMI action. At Step 503: providing a plurality CMDI systems that respectively emits electromagnetic emissions within one frequency range falling within said selected or determined visual, near-infra-red, or infrared spectrum, wherein each of CMDI system comprises: a chemiluminescent device (CD) that emits said electromagnetic emissions within said one frequency range, wherein said CD is further formed with a first end and a second end, wherein the CD is formed with a breakable internal vessel comprising a first liquid, wherein the CD is further formed with a flexible outer housing that is further filled with a second liquid, wherein the first and second liquid when combined after flexing of the flexible outer housing and breakage of the breakable internal vessel form a chemiluminescent compound or mixture that emits one of a plurality of visual, near infrared, or infrared spectrum light emissions, wherein the second end is formed with an CD attachment section formed with at least an CD attachment section aperture and hook structure, wherein the CD attachment section extends away from the CD body, wherein each of said selected or determined electromagnetic frequencies associated with a CDMI action is further associated with respective ones of said plurality of visual, near infrared, or infrared spectrum light emissions from each of said CDMI systems; a tactile selection structure comprising: a first cap formed with a tactile selection shape, wherein the first cap has a first and second cap end opposing said first cap end, said first cap end is further formed with a first cylindrical section with enclosing walls and having a first open end that is formed so that one end of said case inserts into said first open end, wherein said first cap is formed with a one of a plurality of said tactile sensory based emitter selection or identification structures comprising a square, a pyramid, cylinder, and rounded shapes. At Step 505: coupling together a plurality of the CMDIs that emit different ones of said plurality of visual, near infrared, or infrared spectrum light emissions. At Step 507: providing a mobile storage or employment structure comprising attachment or storage structures comprising a vest or garment with pockets or loop attachment structures. Step 509: coupling the cord or loop to a section of the mobile storage system or employment structure. Step 511: moving into a lower or no visibility location with the number of CDMIs. Step 513: identifying one of said communication actions associated with a respective one of the plurality of the tactile sensory based emitter selection or identification structures. Step 515: selecting one of the number of the CMDIs with a respective said first cap formed with said respective one of the number of tactile sensor based selection or identification structures. Step 517: withdrawing and activating said selected one of the CMDIs from the mobile storage system or employment structure. At Step 519: placing, coupling, or moving the selected and activated one of said CMDI systems in in accordance with a selected one of said CDMI actions.

Exemplary embodiments of the plurality of CMDI systems can include at least two or more different tactile sensory-based emitter selection or identification structures including a square, a pyramid, cylinder, or rounded shapes. Various embodiments can include examples where at least the first cap's first cylindrical section's enclosing walls are formed with a wall thickness and material section that require a first force to screw the first cap onto the first end of the CD without rupturing the first end of the CD or tearing or splitting the first cylindrical section's enclosing walls, wherein said first force is no more than ten to fifteen inch pounds of torque. Exemplary first and second caps can be formed with a material than is harder than the first end of the CD, wherein the first end of the CD is formed of a plastic material that deforms or is cut into when the first end cap is screwed on the first end of the CD but does not rupture the CD structure.

Various embodiments can include examples where the selected or determined electromagnetic frequencies include electromagnetic energy within visual, near-infrared, or infrared spectrum. Exemplary embodiments can include examples where at least one CMDI system further includes a case structure formed to receive a portion of the CD that is formed with a quick release structure comprising a tear strip or coupler that enables the case to be quickly removed wherein the case is formed to block light emissions from the CD until removed.

Examples can further include embodiments where the first cap is formed with a first set of self-tapping internal threads adapted to grip or cut into said first end of the CD. Embodiments can also include examples where at least one CDMI system further includes: a second cap formed with internal threads formed with a second set of self-tapping internal threads adapted to grip or cut into the second end of CD, wherein the second end cap is further formed with an end cap aperture that is adapted to receive and allow the CD attachment section to protrude from so that the CD body attachment aperture is not covered by the second cap; a first and second lanyard connection section respectively formed into the first and second cap; and an elastic line, wherein a first end of the elastic line is coupled with said first lanyard connection section and a second end of the elastic line is coupled with the second lanyard connection section, wherein said elastic line is formed with a length that applies a first elastic compressive force pulling the first second caps together.

Various embodiments can include examples where the step of withdrawing and activating the selected one of said CMDIs from the mobile storage system or employment structure includes ripping the CMDI from the cord or loop that is coupled to the mobile storage system or employment structure and thereby tearing or opening a portion of the CD attachment section to allow the cord or loop to pass from an affected CD attachment section aperture. Embodiments can further include examples where the coupling together of a number of the CMDIs that emit different ones of the number of visual, near infrared, or infrared spectrum light emissions can include a step of passing a cord or loop through all of said CD attachment section apertures.

Although the invention has been described in detail with reference to certain preferred embodiments, variations and modifications exist within the spirit and scope of the invention as described and defined in the following claims.

The invention claimed is:

1. A method of configuring, loading, selecting, and employing one of a number of visual, near-infrared, or infrared emitters from a plurality of such emitters using tactile sensory based emitter selection or identification structures comprising:

selecting a plurality of electromagnetic frequencies to communicate, mark, designate, or indicate (CMDI), wherein said selected electromagnetic frequencies comprise electromagnetic energy within visual, near-infrared, or infrared spectrum, wherein each of said selected electromagnetic frequencies is associated with a marking, communicating, designating, identifying action;

providing a mobile storage or employment structure comprising attachment or storage structures comprising a vest or garment with pockets or loop attachment structures;

providing a plurality CMDI systems that respectively emits electromagnetic emissions within one frequency range falling within said selected visual, near-infra-red, or infrared spectrum, wherein each of CMDI system comprises:

a chemiluminescent device (CD) that emits said electromagnetic emissions within said one frequency range, wherein said CD is further formed with a first end and a second end, wherein the CD is formed with a breakable internal vessel comprising a first liquid, wherein the CD is further formed with a flexible outer housing that is further filled with a second liquid, wherein the first and second liquid when combined after flexing of the flexible outer housing and breakage of the breakable internal vessel form a chemiluminescent compound or mixture that emits one of a plurality of visual, near-infra-red, or infrared spectrum light emissions, wherein the second end is formed with an CD attachment section formed with at least an CD attachment section aperture and hook structure, wherein the CD attachment section extends away from the CD body;

a case formed to receive a portion of the CD that is formed with a quick release structure comprising a tear strip or coupler that enables the case to be quickly removed wherein the case is formed to block light emissions from the CD until removed; a tactile selection structure comprising:

a first cap formed with a tactile selection shape, wherein the first cap has a first and second cap end opposing said first cap end, said first cap end is further formed with a first cylindrical section with enclosing walls and having a first open end that is formed so that one end of said case inserts into said first open end, wherein said first cap is formed with a one of a plurality of said tactile sensory based emitter selection or identification structures comprising a square, a pyramid, cylinder, and rounded shapes, wherein the first cap is formed with a first set of self-tapping internal threads adapted to grip or cut into said first end of the CD;

a second cap formed with internal threads formed with a second set of self-tapping internal threads adapted to grip or cut into the second end of CD, wherein the second end cap is further formed with an end cap aperture that is adapted to receive and allow the CD attachment section to protrude from so that the CD body attachment aperture is not covered by the second cap;

a first and second lanyard connection section respectively formed into the first and second cap; and an elastic line, wherein a first end of the elastic line is coupled with said first lanyard connection section and a second end of the elastic line is coupled with the second lanyard connection section, wherein said elastic line is formed with a length that applies a first elastic compressive force pulling the first second caps together; coupling together a plurality of the CMDIs that emit different ones of said plurality of visual, near infrared, or infrared spectrum light emissions by passing a cord or loop through all of said CD attachment section apertures then coupling the cord or loop to a section of the mobile storage system or employment structure;

donning gloves and moving into a low or no light area with the CMDIs; identifying one of said CMDI actions associated with a respective one of said plurality of said tactile sensory based emitter selection or identification structures;

selecting one of said plurality of the CMDI systems with a respective said first cap formed with said respective one of said plurality of tactile sensor based selection or identification structures; and withdrawing and activating said selected one of said CMDI systems from the mobile storage system or employment structure by ripping the CMDI system from the cord or loop that is coupled to the mobile storage system or employment structure and thereby tearing or opening a portion of the CD attachment section to allow the cord or loop to pass from an affected CD attachment section aperture; and placing, coupling, or moving the selected and activated one of said CMDI systems in in accordance with a selected one of said CDMI actions;

wherein at least some said plurality of CMDI systems have at least two or more different tactile sensory based emitter selection or identification structures comprising a square, a pyramid, cylinder, or rounded shapes; wherein said plurality of CMDI systems are grouped together and attached to said mobile storage or employment structure;

wherein at least the first cap's the first cylindrical section's enclosing walls are formed with a wall thickness and material section that require a first force to screw the first cap onto the first end of the CD without rupturing the first end of the CD or tearing or splitting the first cylindrical section's enclosing walls, wherein said first force is no more than ten inch pounds of torque;

wherein the first and second caps are formed with a material that is harder than the first end of the CD, wherein the first end of the CD is formed of a plastic material that deforms or is cut into when the first end cap is screwed on the first end of the CD but does not rupture the CD structure.

2. A method as in claim 1, wherein a thickness of the first and second end caps is not less than 1/16th of an inch when manufacturing the end caps with ABS or PLA produced with an additive manufacturing process.

3. A method as in claim 1, wherein the CMDI actions comprise placing the CD at a location that is within a field of view of an observer, throwing the CD with respect to a target location, coupling the CD with an object, or moving the CD with respect to field of view observable from an external observation point or points to attract attention of an observer at the external observation point or points.

4. A method of configuring, loading, selecting, and employing one of a number of visual, near-infrared, or infrared emitters from a plurality of such emitters using tactile sensory based emitter selection or identification structures comprising:

selecting a plurality of electromagnetic frequencies to communicate, mark, designate, or indicate (CMDI), wherein each of said selected electromagnetic frequencies is associated with a CDMI action;

providing a plurality CMDI systems that respectively emits electromagnetic emissions within one frequency range falling within said selected visual, near-infra-red, or infrared spectrum, wherein each of CMDI system comprises:

a chemiluminescent device (CD) that emits said electromagnetic emissions within said one frequency range, wherein said CD is further formed with a first end and a second end, wherein the CD is formed with a breakable internal vessel comprising a first liquid, wherein the CD is further formed with a flexible outer housing that is further filled with a second liquid, wherein the first and second liquid when combined after flexing of the flexible outer housing and breakage of the breakable internal vessel form a chemiluminescent compound or mixture that emits one of a plurality of visual, near infrared, or infrared spectrum light emissions, wherein the second end is formed with an CD attachment section formed with at least an CD attachment section aperture and hook structure, wherein the CD attachment section extends away from the CD body, wherein each of said selected electromagnetic frequencies associated with said CDMI action is further associated with respective ones of said plurality of visual, near infrared, or infrared spectrum light emissions from each of said CDMI systems;

a tactile selection structure comprising:

a first cap formed with a tactile selection shape, wherein the first cap has a first and second cap end opposing said first cap end, said first cap end is further formed with a first cylindrical section with enclosing walls and having a first open end that is formed so that one end of said case inserts into said first open end, wherein said first cap is formed with a one of a plurality of said tactile sensory based emitter selection or identification structures comprising a square, a pyramid, cylinder, and rounded shapes;

coupling together a plurality of the CMDIs that emit different ones of said plurality of visual, near infrared, or infrared spectrum light emissions; identifying one of said communication actions associated with a respective one of said plurality of said tactile sensory based emitter selection or identification structures; selecting one of said plurality of the CMDIs with a respective said first cap formed with said respective one of said plurality of tactile sensor based selection or identification structures; and withdrawing and activating said selected one of said CMDIs from a mobile storage system or employment structure; placing, coupling, or moving the selected and activated one of said CMDI systems in in accordance with a selected one of said CDMI actions; wherein at least some said plurality of CMDI systems have at least two or more different tactile sensory based emitter selection or identification structures comprising a square, a pyramid, cylinder, or rounded shapes wherein at least the first cap's the first cylindrical section's enclosing walls are formed with a wall thickness and material section that require a first force to screw the first cap onto the first end of the CD without rupturing the first end of the CD or tearing or splitting the first cylindrical section's enclosing walls, wherein said first force is no more than ten inch pounds of torque;

wherein the first and second caps are formed with a material that is harder than the first end of the CD, wherein the first end of the CD is formed of a plastic material that deforms or is cut into when the first end cap is screwed on the first end of the CD but does not rupture the CD structure.

5. A method as in claim 4 further comprising: providing said mobile storage or employment structure comprising attachment or storage structures comprising a vest or garment with pockets or loop attachment structures; and coupling the cord or loop to a section of the mobile storage system or employment structure.

6. A method as in claim 4, wherein said selected electromagnetic frequencies comprise electromagnetic energy within visual, near-infrared, or infrared spectrum.

7. A method as in claim 4, wherein at least one CMDI system further comprises a case formed to receive a portion of the CD that is formed with a quick release structure comprising a tear strip or coupler that enables the case to be quickly removed wherein the case is formed to block light emissions from the CD until removed.

8. A method as in claim 4, wherein the first cap is formed with a first set of self-tapping internal threads adapted to grip or cut into said first end of the CD.

9. A method as in claim 4, wherein at least one CDMI system further comprises:

a second cap formed with internal threads formed with a second set of self-tapping internal threads adapted to grip or cut into the second end of CD, wherein the second end cap is further formed with an end cap aperture that is adapted to receive and allow the CD attachment section to protrude from so that the CD body attachment aperture is not covered by the second cap;

a first and second lanyard connection section respectively formed into the first and second cap; and an elastic line, wherein a first end of the elastic line is coupled with said first lanyard connection section and a second end of the elastic line is coupled with the second lanyard connection section, wherein said elastic line is formed with a length that applies a first elastic compressive force pulling the first second caps together.

10. A method as in claim 8, further comprising removing the second cap from the CD.

11. A method as in claim 4, wherein said withdrawing and activating said selected one of said CMDIs from the mobile storage system or employment structure comprises ripping the CMDI from a cord or loop that is coupled to the mobile storage system or employment structure and thereby tearing or opening a portion of the CD attachment section to allow the cord or loop to pass from an affected CD attachment section aperture.

12. A method as in claim 4, wherein said coupling together a plurality of the CMDIs that emit different ones of said plurality of visual, near infrared, or infrared spectrum light emissions comprises passing a cord or loop through all of said CD attachment section apertures.

13. A signaling and communication device, comprising: a chemiluminescent device (CD) that emits electromagnetic emissions within one frequency range, wherein said CD is further formed with a first end and a second end, wherein the CD is formed with a breakable internal vessel comprising a first liquid, wherein the CD is further formed with a flexible outer housing that is further filled with a second liquid, wherein the first and second liquid when combined after flexing of the flexible outer housing and breakage of the breakable internal vessel form a chemiluminescent compound or mixture that emits one of a plurality of visual, near-infra-red, or infrared spectrum light emissions, wherein the second end is formed with an CD attachment section formed with at least an CD attachment section aperture and hook structure, wherein the CD attachment section extends away from the CD body; a case formed to receive a portion of the CD that is formed with a quick release structure comprising a tear strip or coupler that enables the case to be quickly removed wherein the case is formed to block light emissions from the CD until removed; a tactile selection structure comprising: a first cap formed with a tactile selection shape, wherein the first cap has a first and second cap end opposing said first cap end, said first cap end is further formed with a first cylindrical section with enclosing walls and having a first open end that is formed so that one end of said case inserts into said first open end, wherein said first cap is formed with a one of a plurality of said tactile sensory based emitter selection or identification structures comprising a square, a pyramid, cylinder, and rounded shapes; a first and second lanyard connection section respectively formed into the first and second cap; and an elastic line, wherein a first end of the elastic line is coupled with said first lanyard connection section and a second end of the elastic line is coupled with the second lanyard connection section, wherein said elastic line is formed with a length that applies a first elastic compressive force pulling the first and second caps together.

14. The signaling and communication device of claim 13, wherein a thickness of the first and second end caps is not less than 1/16th of an inch when manufacturing the end caps with ABS or PLA produced with an additive manufacturing process.

15. The signaling and communication device of claim 13, wherein the first cap is formed with a first set of self-tapping internal threads adapted to grip or cut into said first end of the CD;

wherein the second cap formed with internal threads formed with a second set of self-tapping internal threads adapted to grip or cut into the second end of CD; and wherein the second end cap is further formed with an end cap aperture that is adapted to receive and allow the CD attachment section to protrude from so that the CD body attachment aperture is not covered by the second cap.

* * * * *